United States Patent [19]

Verstraeten

[11] 4,136,520

[45] Jan. 30, 1979

[54] HYDRAULIC PILE DRIVER

[76] Inventor: Alexander J. Verstraeten, P.O. Box 55, Oostburg, Netherlands

[21] Appl. No.: 806,720

[22] Filed: Jun. 15, 1977

[30] Foreign Application Priority Data

Jun. 15, 1976 [NL] Netherlands ..... 7606451

[51] Int. Cl.[2] ..... F15B 1/02

[52] U.S. Cl. ..... 60/371; 60/413; 91/325; 91/402

[58] Field of Search ..... 60/371, 372, 413, 414; 91/325, 340, 402, 403, 404; 72/453.01, 453.1; 173/90; 175/25

[56] References Cited

U.S. PATENT DOCUMENTS

| | | | |
|---|---|---|---|
| 1,870,499 | 8/1932 | Ernst | 91/402 |
| 3,332,273 | 7/1967 | Beche | 60/371 |
| 3,777,491 | 12/1973 | Bender | 60/372 |

*Primary Examiner*—Edgar W. Geoghegan
*Attorney, Agent, or Firm*—B. P. Fishburne, Jr.

[57] ABSTRACT

A hydraulic pile driver of the kind having at least one hydraulic cylinder for raising a tup. An arrangement is proposed for allowing the use of oil as the hydraulic fluid. The cylinder has a closed chamber around it, to which oil under pressure is supplied. An apertured cuff around or within the cylinder is moved to bring its apertures periodically into and out of registry with apertures in the cylinder wall to connect the cylinder space alternately with said chamber for supply of fluid to the cylinder and to a discharge line for the discharge of fluid from the cylinder. The volume of the chamber is considerably greater than the volume of the cylinder space. The apertures in the cuff and the cylinder wall that register for discharge of the oil from the cylinder have a total cross-sectional area at least equal to that of the cylinder space to make for fast discharge of the oil, thereby ensuring free fall of the tup.

2 Claims, 5 Drawing Figures

HYDRAULIC PILE DRIVER

This invention relates to a hydraulic pile driver of the kind comprising at least one hydraulic cylinder for raising a tup, a fluid-supply line for passing a fluid under pressure to the cylinder space of the cylinder, and a control slide for periodically connecting the cylinder space to a fluid-discharge line, said control slide being a cuff having apertures therein and mounted within or around part of the peripheral wall of the cylinder for movement from a position in which the fluid under pressure is supplied to a position in which the fluid under pressure is discharged from the cylinder.

A pile driver of this kind is disclosed in Dutch patent application No. 71,97462, and designed to use air as the pressure fluid, which can be directly discharged from the cylinder to the ambient atmosphere. This renders the prior apparatus unsuitable for use with a different pressure fluid, such as oil, which is preferable in particular for reasons of regulating engineering.

It is an object of the present invention to provide a hydraulic pile driver in which oil can be used as the pressure fluid. To ensure high tup speeds, it is necessary that the oil present in the cylinder can be discharged at a high rate, which of course calls for minimum flow resistance.

According to the present invention, there is provided a hydraulic pile driver comprising at least one hydraulic cylinder for raising a tup, a fluid-supply line for passing a fluid under pressure to the cylinder space of the cylinder, and a control slide for periodically connecting the cylinder space to a fluid-discharge line, said control slide being a cuff having apertures therein and mounted within or around part of the peripheral wall of the cylinder for movement from a position in which the fluid under pressure is supplied to a position in which the fluid under pressure is discharged from the cylinder, characterized by a closed chamber provided around the cylinder, the volume of said chamber being considerably in excess of that of the cylinder space of the cylinder, said fluid-discharge line being connected to said closed chamber, the total area of the apertures in the cuff and in the cylinder wall that are in registry with each other when fluid under pressure is discharged from the cylinder space to said closed chamber being at least equal to the cross-sectional area of the cylinder space.

According to a preferred feature of the invention, the fluid supply line is adjacent its connection to the cylinder connected to a fluid accumulator for storing the fluid under pressure during the periods in which the fluid supply line is disconnected from the cylinder space.

According to another feature of the invention, in particular for work under water, a flexible reservoir is provided in the top portion of the closed chamber, said reservoir being filled with a gas under pressure for generating a counter-pressure sufficiently high to drive the pressure fluid upwards through the fluid discharge line during under-water pie driving.

One embodiment of the apparatus according to the invention will now be described, by way of example, with reference to the accompanying drawings, wherein FIG. 1 is a partial, diagrammatic view of a pile driver according to the invention;

In the various Figures corresponding parts are indicated by the same reference numerals.

Figure 1:
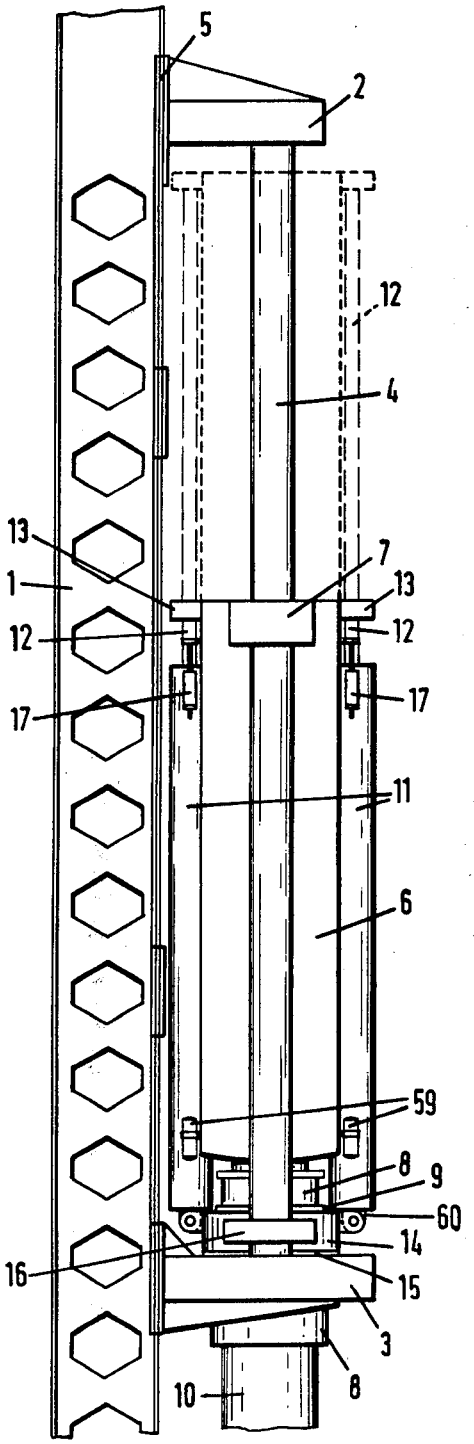

The pile driver shown in FIG. 1 comprises a section 1, slidably mounting two supports 2, 3, which are interconnected by two guide rods 4, shown in FIG. 1 one behind the other, so that only the front guide rod is shown. Supports 2 and 3 are slidable along section 1 as they are both affixed to a guide 5 which is adapted to slide along section 1.

Guide rods 4 guide a tup 6 which for this purpose is provided in longitudinal direction with recesses engaging around guide rods 4, and with an additional guide block 7. The tup is adapted to effect an up-and-down stroke between supports 2 and 3. In its lowermost position (as shown in FIG. 1) the tup rests on a pile cap 8 which is fixed in the lower support 3, slightly resiliently, for instance by means of a rubber cuff 9. The cap 8 rests on a pile 10 which is being piled into the ground.

Tup 6 is displaced between supports 2 and 3 and along guide rods 4 by lifting cylinders 11 whose piston rods 12 are connected to tup 6 via supports 13 of tup 6. Cylinders 11 are furthermore attached to an annular member 14 which rests on support 3 via e.g. a rubber sheet 15 and is secured to guide rods 4 by means of blocks 16, so as to be slightly slidable on these rods 4. Hydraulic or pneumatic cylinders 17 are provided for operating the hydraulic lifting cylinders 11.

Figure 2:
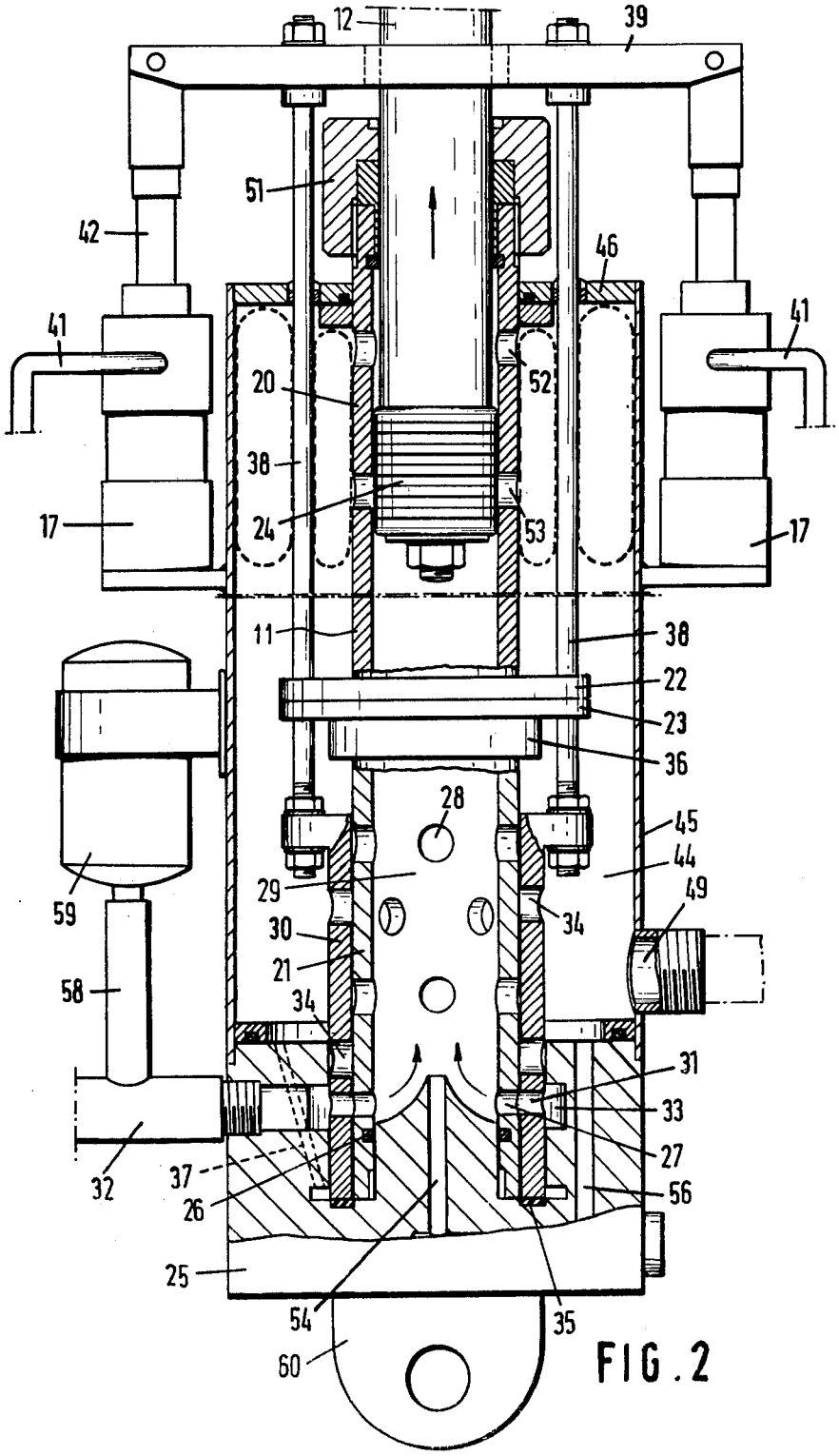
FIGS. 2 and 3 are diagrammatic cross-sections of a lifting cylinder.
Figure 3:
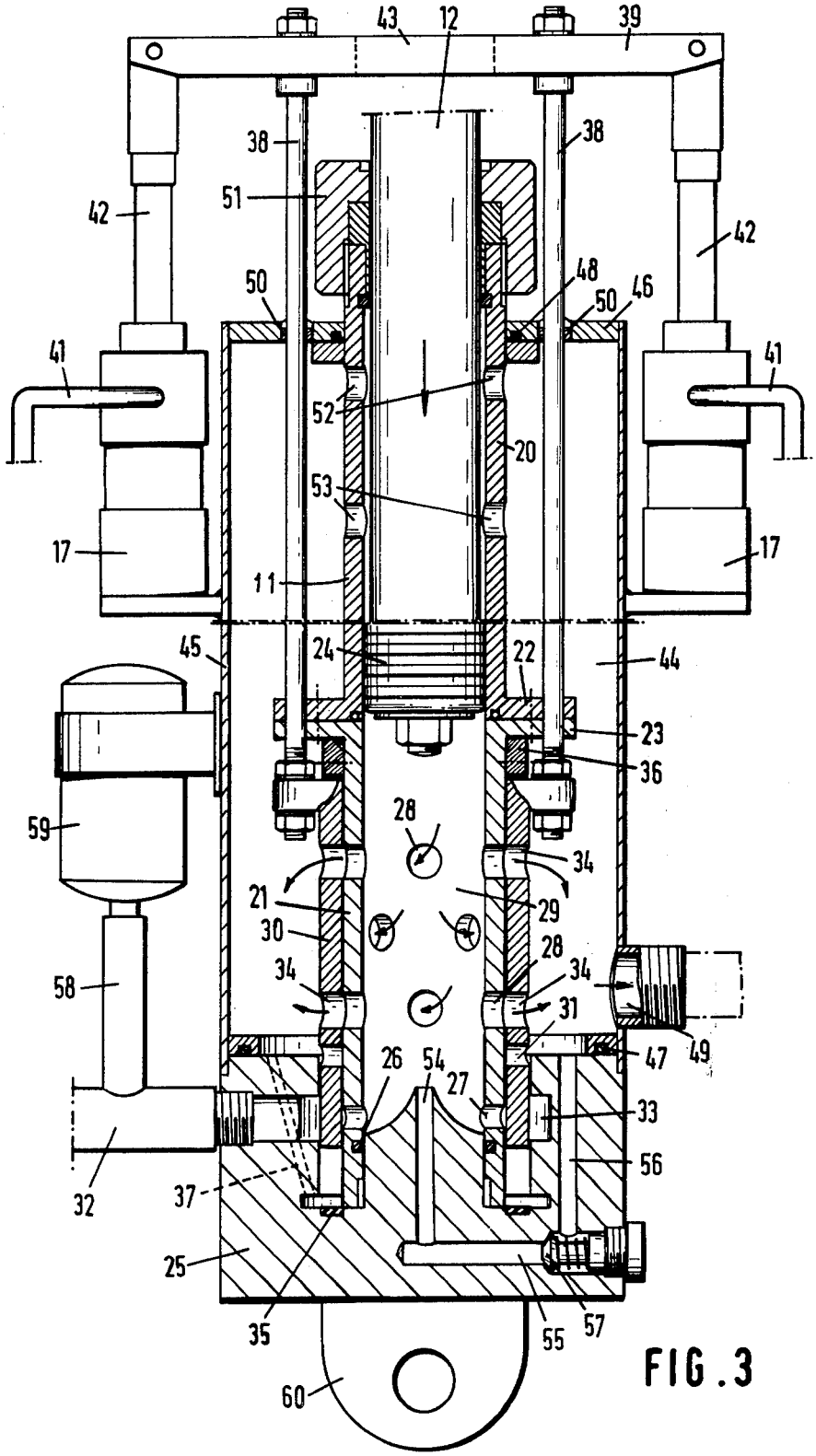

FIGS. 2 and 3 diagrammatically show longitudinal sections of a lifting cylinder 11, showing piston rod 12 moving upwardly (FIG. 2) and downwardly (FIG. 3).

As shown in FIGS. 2 and 3, cylinder 11 comprises a cylindrical wall portion 20 and a contiguous cylindrical wall portion 21, which portions are interconnected through flanges 22 and 23, which are secured together e.g. by means of bolts. A piston 24, fixed on the piston rod 12, is adapted for up and down movement, the stroke lying substantially within the cylinder wall portion 20.

Wall portion 21 is closed at the bottom with a base portion 25 having an annular recess, into which wall portion 21 extends. An O-ring 26 serves to provide a liquid-tight seal.

Cylinder wall portion 21 is provided with a plurality of apertures 27 for supplying hydraulic fluid to, and a plurality of apertures 28 for discharging hydraulic fluid from, cylinder space 29. The supply and discharge of the fluid is controlled by sliding, i.e. axial displacement of a cuff 30 mounted around the cylinder wall portion 21. When said cuff 30 is in the lowermost position (FIG. 2), apertures 31 of cuff 30 are in register with apertures 27 in the cylinder wall portion 21, so that fluid under pressure can be supplied via fluid supply line 32 to cylinder space 29, as indicated by arrows in FIG. 2. To this effect the base portion 25 comprises an annular chamber 33 disposed around cuff 30 and communicating with fluid supply line 32.

When cuff 30 is in its uppermost position (FIG. 3), the fluid supply is shut off by a web portion of cuff 30, shifted between chamber 33 and apertures 27. In this uppermost position, apertures 28 in cylinder wall portion 21 are in register with apertures 34 in cuff 30, so that, as shown by arrows, fluid can drain from cylinder space 29.

Cuff 30 accordingly is slidable between a lowermost position, wherein fluid can be supplied to the cylinder space 29, and an uppermost position wherein fluid from the cylinder space 29 can be discharged. The total area of apertures 28, 34 in cuff 30 and wall 21 which are in registry when fluid is discharged from cylinder space 29 to chamber 44 is at least equal to the cross-sectional area of cylinder space 29. In the lowermost position cuff 30 rests against a, possibly flexible, ring 35 and in the uppermost position against a, possibly flexible, ring 36 disposed around cylinder wall portion 21. Via a line 37, diagrammatically shown in broken lines, fluid can flow away from the annular recess of base portion 25 when cuff 30 is moved downwardly.

Cuff 30 is displaced by means of two operating rods 38. Both ends of rods 38 are threaded for attachment on the one hand to cuff 30 and on the other hand to a crosshead 39 by means of nuts. Crosshead 39 can be moved up and down by means of hydraulic or pneumatic operating cylinders 17. For this purpose a fluid under pressure can be conducted through line 41 to cylinders 17, whereby piston rods 42, mounted on crosshead 39, are displaced. Crosshead 39 is provided with an aperture 43 for allowing the passage of piston rod 12.

Cylinder 11 is furthermore provided with an outlet chamber 44, wherein the fluid flowing from cylinder space 29 is collected. The volume of chamber 44 is considerably greater than the volume of cylinder space 29. Outlet chamber 44 is mounted around the cylinder wall portions 20 and 21 and is enclosed by a tubular circumferential wall 45 which at one end adjoins base portion 25 and at the other end an annular end wall 46. Circumferential wall 45 and end wall 46 of the outlet chamber are interconnected, for example, by welding. O-rings 47 and 48 are arranged to provide liquid-tight seals between wall 45 and base portion 25, and between wall 45 and end wall 46. In the circumferential wall 45 of the outlet chamber 44 there is mounted a fluid discharge line 49 through which the fluid present in the outlet chamber 44 can flow away to, for instance, a fluid reservoir, not shown.

Guide rods 38 are passed through fluid-tight passages 50 in end wall 46 and furthermore pass through apertures provided in flanges 22 and 23 of cylinder wall portions 20 and 21.

Cylinder wall portion 20 is provided at the top with a screwed-on guide 51 for piston rod 12, which guide encloses piston rod 12 in fluid-tight fashion. Cylinder wall portion 20 is furthermore provided with apertures 52 and 53 through which any fluid leaking along the piston 24 can flow towards outlet chamber 44. Apertures 53 also serve for limiting the stroke of piston 24, since, after passing recesses 53, it cannot be moved further upwardly because the recesses 53 will then directly connect the cylinder space 29 to the outlet chamber 44.

For protecting the lifting cylinder against excessive pressure surges in cylinder space 29, lines 54, 55 and 56 are provided through which fluid can flow from cylinder space 29 via a spring-loaded non-return valve 57 to outlet chamber 44.

Adjacent its connection to the lifting cylinder a line 58 is connected to fluid supply line 32 for conducting fluid to and from a partially gas-filled fluid accumulator 59 in which fluid under pressure can be stored.

Furthermore lifting cylinder 11 is provided at its bottom with an eye 60 by means of which the cylinder can be attached to annular member 14 (see also FIG. 1).

The operation of the lifting cylinder is as follows. When tup 6 is moved upwardly, cuff 30 is in its lowermost position, as shown in FIG. 2. Via line 32 hydraulic fluid is supplied by pumping means, not shown, which fluid flows through apertures 31 in cuff 30 and apertures 27 in cylinder wall portion 21 to cylinder space 29. Apertures 28 in cylinder wall portion 21 are shut off by cuff 30 so that the inflowing fluid under pressure urges piston 24 of the lifting cylinder upwardly. Via supports 13, to which piston rod 12 of piston 24 is connected, the tup 6 is thus moved upwardly. When the tup 6 has been brought to a desired height, operating cylinders 17 are energized through lines 41 to move piston rods 42 and thereby crosshead 39, operating rods 38 and cuff 30 upwardly to the uppermost position, as shown in FIG. 3.

Operating cylinders 17 can be operated manually at the appropriate moment. It is also possible to provide a switch, for instance on the guide rod 4, which is adapted to cooperate with a cam disposed on the tup, said switch controlling the fluid supply and discharge to and from cylinders 17. By making the switch and/or the cam movable in the vertical direction, the height of fall of the tup can be adjusted.

Operating cylinders 17 can be energized by supplying fluid pressure to lines 41 at the appropriate moment, so that piston rod 42 moves upwardly, whereas when the fluid pressure is removed, piston rod 42 moves downwardly.

The maximum height of fall, for instance two meters, is defined by apertures 53 provided in cylinder wall portion 20, which in the case of undue upward movement of piston 24, connect cylinder space 29 to outlet chamber 44.

When cuff 30 is moved first apertures 27 of cylinder wall portion 21 are shut off from supply line 32, after which apertures 34 of cuff 30 are brought into registry with apertures 28 of cylinder wall portion 21.

After cuff 30 has been brought to its uppermost position, the falling movement of the tup begins, with fluid from cylinder space 29 flowing to outlet chamber 44 via recesses 28 and 34, as shown in FIG. 3. A partial vacuum may be maintained in outlet chamber 44 by drawing the fluid, and possibly the gas present above the fluid, off via line 49. This is possible, for instance, by connecting line 49 to a closed fluid reservoir wherein a partial vacuum is maintained.

The downward stroke of piston 12 terminates when tup 6 contacts pile cap 8 (FIG. 1). After movement of cuff 30 to its lowermost position, the next upward stroke begins. This movement may be effected by means of a switch which is responsive to the impact produced by tup 6 to actuate cylinders 17.

During the periods in which apertures 27 of cylinder wall portion 21 are shut off, i.e., in the uppermost position of cuff 30 (FIG. 3), the fluid supplied via line 32 is passed through line 58 to fluid accumulator 59 wherein the fluid under pressure is stored until fluid can be supplied to cylinder space 29. The fluid stored in accumulator 59 can then flow to cylinder space 29, too, so that on the one hand cylinder space 29 is filled more quickly and on the other hand the fluid supply via line 32 need not be interrupted constantly.

The application of cuff 30 enables a very rapid and effective opening and closure of the fluid supply and discharge ports, so that the fluid encounters a minimal flow resistance during the discharge thereof.

Figure 4:
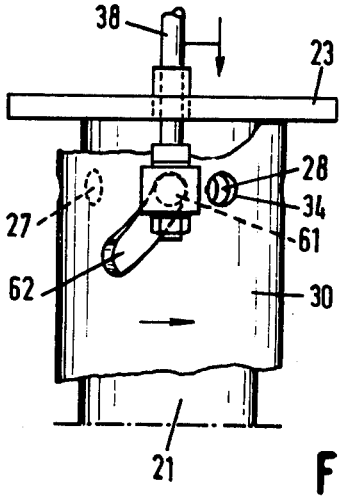
FIGS. 4 and 5 are a diagrammatic side view and a top view, respectively, of an alternative adjusting mechanism for the sleeve.
Figure 5:
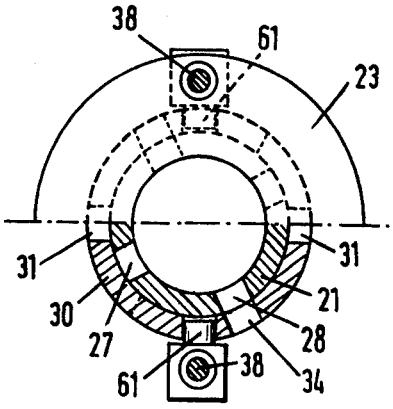

FIGS. 4 and 5 show an alternative construction for the movement of cuff 30, wherein it makes a rotating instead of an axial movement. For this purpose operating rods 38 are provided at their bottom ends with a cam 61 which coacts with a guide slot 62 of cuff 30. Axial displacement of operating rods 38 will thus result in rotation of cuff 30 about cylinder wall portion 21, as indicated by arrows in FIG. 5. The remainder of the operation is identical to that described above. In one extreme position of cuff 30, the inlet apertures 31 are in registry with the inlet apertures 27 of cylinder wall portion 21 and in the other extreme position of cuff 30, the outlet apertures 34 register with outlet apertures 28 in cylinder wall portion 21. The diagrammatic FIGS. 4, 5 do not show all the apertures.

Although, in the embodiment described, cuff 30 is mounted to surround cylinder wall portion 21, the same advantages can be achieved when cuff 30 is disposed inside cylinder wall portion 21, in which case only the construction of the operating means for cuff 30 have to be slightly modified.

Furthermore it is possible, during the upward stroke of tup 6, to tension a spring or to compress air in an air cylinder so that energy is stored which during the downward stroke may impart an additional acceleration to the tup. During pile driving at an angle, this can be a necessary feature.

The above-described construction may be surrounded by a diving bell open at the bottom, to which compressed air is supplied, thus allowing pile driving out under water.

I claim:

1. A hydraulic pile driver comprising at least one hydraulic cylinder for raising a tup, a fluid-supply line for passing a fluid under pressure to a cylinder space of the cylinder, and a control slide for periodically connecting the cylinder space to a fluid-discharge line, said control slide being a cuff having apertures therein and mounted within or around part of the peripheral wall of the cylinder for movement from a position in which the fluid under pressure is supplied to the cylinder, to a position in which the fluid under pressure is discharged from the cylinder, characterized by a closed chamber (44) provided around the cylinder (11), the volume of said chamber being considerably in excess of that of the cylinder space (29) of the cylinder (11), said fluid-discharge line (49) being connected to said closed chamber (44), the total area of the apertures (28, 34) in the cuff (30) and in the cylinder wall (21) that are in registry with each other when fluid under pressure is discharged from the cylinder space (29) to said closed chamber (44) being at least equal to the cross-sectional area of the cylinder space (29).

2. A hydraulic pile driver according to claim 1, wherein the fluid-supply line is, adjacent its connection to the cylinder, connected to a fluid accumulator for storing the fluid under pressure during the periods in which the fluid supply line is disconnected from the cylinder space.

* * * * *